US011130211B2

(12) United States Patent
Eisenblaetter

(10) Patent No.: US 11,130,211 B2
(45) Date of Patent: Sep. 28, 2021

(54) POLISHING TOOL WITH INTEGRATED POLISHING PASTE

(71) Applicant: GERD EISENBLAETTER GMBH, Geretsried (DE)

(72) Inventor: Gerd Eisenblaetter, Geretsried (DE)

(73) Assignee: GERD EISENBLAETTER GMBH, Geretsried (DE)

( * ) Notice: Subject to any disclaimer, the term of this patent is extended or adjusted under 35 U.S.C. 154(b) by 369 days.

(21) Appl. No.: 15/491,133

(22) Filed: Apr. 19, 2017

(65) Prior Publication Data

US 2017/0355064 A1 Dec. 14, 2017

(30) Foreign Application Priority Data

Apr. 21, 2016 (DE) ..... 202016002602.0

(51) Int. Cl.

| | |
|---|---|
| ***B24D 3/00*** | (2006.01) |
| ***B24D 3/34*** | (2006.01) |
| ***B24D 11/02*** | (2006.01) |
| ***B24D 13/02*** | (2006.01) |
| ***B24D 13/14*** | (2006.01) |
| ***B24D 13/12*** | (2006.01) |
| ***B24D 15/04*** | (2006.01) |

(52) U.S. Cl.

CPC ..... *B24D 3/346* (2013.01); *B24D 3/002* (2013.01); *B24D 11/02* (2013.01); *B24D 13/12* (2013.01); *B24D 13/147* (2013.01); *B24D 15/04* (2013.01)

(58) Field of Classification Search

CPC ..... B24D 3/001; B24D 3/002; B24D 3/34; B24D 3/346; B24D 11/003; B24D 11/02

USPC ..... 451/526, 530, 533

See application file for complete search history.

(56) References Cited

U.S. PATENT DOCUMENTS

| | | | | |
|---|---|---|---|---|
| 2,177,992 | A * | 10/1939 | Moon | B24B 57/04 451/19 |
| 3,648,317 | A * | 3/1972 | Lewis | A47L 23/06 15/29 |
| 3,990,192 | A * | 11/1976 | Bonnice | B24B 57/04 451/56 |
| 2003/0220061 | A1* | 11/2003 | Prasad | B24B 37/24 451/526 |
| 2005/0136805 | A1* | 6/2005 | Suzuki | C09G 1/02 451/41 |
| 2006/0022368 | A1* | 2/2006 | Lee | B24B 37/24 264/51 |
| 2008/0200102 | A1* | 8/2008 | Feng | B24B 37/24 451/59 |
| 2011/0070814 | A1* | 3/2011 | Feng | B24B 37/24 451/527 |
| 2012/0309273 | A1* | 12/2012 | Popov | B24D 15/023 451/57 |
| 2013/0025429 | A1* | 1/2013 | Eisenblaetter | B24D 9/08 83/676 |
| 2017/0216990 | A1* | 8/2017 | Messmer | B24B 29/00 |

* cited by examiner

*Primary Examiner* — Eileen P Morgan

(74) *Attorney, Agent, or Firm* — Grossman, Tucker, Perreault & Pfleger, PLLC

(57) ABSTRACT

A polishing tool with a carrier comprising a polishing surface on which a polishing paste is applied at least in some areas, wherein the polishing surface consists of a nonwoven fabric, the polishing paste is in a solid state at room temperature and is applied on the polishing surface to be covered in an amount of 0.08 g/cm$^2$ to 0.30 g/cm$^2$.

19 Claims, 1 Drawing Sheet

POLISHING TOOL WITH INTEGRATED POLISHING PASTE

FIELD

The invention relates to a polishing tool used for machining the surface of a workpiece, e.g. one made of metal. The polishing tool is used for smoothing a metal surface, e.g. one of stainless steel, aluminum, copper or brass, or for giving said surface a certain texture. The polishing tool here can be operated manually or be driven by a machine, for which purpose a stationary, installed grinding or polishing unit or a handheld grinding or polishing machine can be used. The polishing tool can also have different forms. In particular, polishing disks, polishing belts, polishing sleeves and polishing pins are customary. Usually, the polishing tool is used in combination with a polishing agent in the form of an oil or a paste, which acts as a coolant and lubricant during the polishing process and usually contains polishing grains that support the polishing process. Depending on their purpose and degree of efficiency, polishing agents with polishing grains with different grain sizes are available.

BACKGROUND

Usually, the polishing agent is applied on the workpiece and/or the polishing tool before the start of the polishing process. This process must be repeated often while polishing. This is laborious and time-consuming Polishing tools have thus been proposed in which the polishing agent has been applied in advance on the surface of the polishing tool or is firmly attached to the same. However, these known polishing tools have the disadvantage that the surface of the polishing tools only takes very little polishing agent so that the polishing agent is already exhausted after a very short period of time and is thus insufficient for longer polishing processes.

SUMMARY

Accordingly, it is the object of the invention to provide a polishing tool which does not have the disadvantages described above and which is suitable in particular for longer polishing processes and the machining of larger surfaces.

The invention is based on the insight that the suitable selection of the carrier of the polishing tool renders possible the provision of larger amounts of polishing paste on the carrier than has been possible to date, thus permitting longer polishing processes and the machining of larger surfaces than in the past. The polishing tool according to the invention has a carrier with a polishing surface consisting of a nonwoven material on which a polishing paste is applied at least in some areas. The polishing paste used is in a solid state at room temperature and is present in an amount of 0.08 $g/cm^2$ to 0.30 $g/cm^2$ of the covered polishing surface, at the locations where the polishing paste is applied. The indication of square centimeters thus refers to the polishing surface covered by the polishing paste.

The polishing surface refers to the surface of the carrier that is used for machining the workpiece and that can come into contact with this workpiece. According to the invention, this polishing surface consists of a nonwoven fabric. This material is characterized by an open structure having a high percentage of pores or cavities in which a relatively high amount of polishing paste can be received. This amount is larger than the amount of polishing paste that can be received on the same surface area of polishing tools used to date, as these have a surface structure that is significantly more closed. One typical example for the material of a conventional polishing tool is, for example, wool felt.

In the polishing tool according to the invention, the polishing paste is distributed on the polishing surface as evenly as possible in an amount in the indicated range. It is preferable if at least 80% of the polishing surface is covered with polishing paste. At least 90% and in particular at least 95% are even more preferable. In the most preferable variant of the invention, the polishing surface is completely covered with polishing paste. This way, a particularly large amount of polishing paste can be provided without the latter having to be applied with a layer thickness that is too great, thus creating the risk that it chips at the very beginning of the polishing process and is no longer usable. The open structure of the polishing surface has the overall advantage that the polishing paste can penetrate deep into the nonwoven fabric and is well connected to the latter, thus considerably reducing the risk of chipping.

In order to be able to apply the polishing paste evenly on the polishing surface, it is expedient to heat the paste for application and modify it from its solid state at room temperature to a liquid or at least viscous state. In this state, the polishing paste can be applied on the polishing surface easily and in a manner known per se. This can be effected by means of immersion, spreading or spraying. Preferably, this occurs in such a way that the deviations in quantity per square centimeter of covered polishing surface are less than 20%, preferably less than 10%, and in particular less than 5%. The polishing paste solidifies after application and thus adheres reliably to the nonwoven fabric at room temperature.

The polishing paste is itself selected in accordance with its intended use. In principle, polishing pastes known in the state of the art and solid at room temperature can be used. Suitable pastes are, for example, pastes that contain an alkaline earth metal salt that is not readily soluble, in particular barium sulfate, and/or ceramic polishing grains. However, plastic polishing grains can also be used for more sensitive materials. The grain size of the polishing grains is also adapted to the intended application in a manner known per se. For example, natural and/or synthetic waxes act as a carrier material for the polishing grains.

It is expedient to select the amount of polishing paste depending on the intended purpose of the polishing tool and nonwoven fabric used. It has proven particularly suitable to apply the polishing paste on the polishing surface to be covered in an amount of 0.10 $g/cm^2$ to 0.25 $g/cm^2$, preferably 0.11 $g/cm^2$ to 0.17 $g/cm^2$.

In a first variant, the carrier on which the polishing paste is applied may consist of an overall nonwoven fabric. Since a nonwoven fabric is often not very stable with respect to its form, it may be expedient to arrange the nonwoven fabric on a carrier layer. In a second variant, the carrier thus comprises a carrier layer on which a layer of nonwoven fabric is arranged as the polishing surface. If the polishing tool has a shape allowing the use of both sides for polishing, a layer of nonwoven fabric may also be provided on both sides of the carrier layer as a polishing surface, on which polishing paste can then also be applied. The layer of nonwoven fabric can be attached to the carrier layer, e.g., by means of needling. However, any other suitable type of attachment is also conceivable. The selection of the carrier layer is not particularly limited. For example, wool is suitable as material for the carrier layer.

The nonwoven fabric used within the scope of the invention may in principle consist of natural or synthetic fibers. The latter is preferred. Suitable synthetic fibers are, e.g., fibers made of polyamide or polyester. Preferably, needle-punched nonwoven fabrics or velourized needle-punched nonwoven fabrics are used.

Prior to the application of the polishing paste, the carrier preferably has a surface weight of between 660 and 990 g/m$^2$, the surface weight being determined for a material thickness of the carrier of 4 mm. The surface weight of the carrier, also referred to as surface-related mass, is conventionally determined by weighing an exactly measured piece of the carrier material on an analysis scale or similar calibrated weighing device which weighs with an accuracy to at least 0.1 mg. The determination occurs in accordance with DIN EN ISO 9073-1. In order to attain a sufficient precision, the weighed piece should not be smaller than 500 cm$^2$ and the average value of weighing operations pertaining to at least three pieces of the carrier material that have been cut to size separately should be used. In contrast to a pure determination the surface weight, the thickness of the carrier material is also considered in accordance with the invention in order to permit inferences regarding the openness of the material structure. The determination of thickness occurs in accordance with DIN EN ISO 9073 using a measuring device with a pressure plate of 2,500 mm$^2$ and a measurement pressure of 0.020 kPa. The preceding specifications regarding the surface mass relate to a carrier material thickness of 4 mm, as explained above. However, this does not mean that only carrier materials with this thickness could be used within the scope of the invention. Rather, in principle carrier materials of any thickness can be used. If a carrier material with a thickness of more than 4 mm is used, the preferred surface weight is accordingly proportionally higher; in the case of thicknesses smaller than 4 mm, it is accordingly proportionally lower than the range indicated for a thickness of 4 mm. Accordingly, a carrier material with a thickness of 4.4 mm, for example, should have a surface weight in the range of 726 to 1,089 g/m$^2$. Particularly preferred surface weights lie in the range of 690 to 910 g/m$^2$, more preferably 720 to 870 g/m$^2$ and especially 750 to 840 g/m$^2$, respectively based on a material thickness of 4 mm.

In order to ensure a sufficient uptake of polishing paste on the polishing surface, it is preferable to use carriers in which the material of the polishing surface has a percentage of pores of at least 90%. The indications regarding the percentage of pores relate only to the nonwoven fabric forming the polishing surface, namely both in the case in which the carrier as a whole consists of a nonwoven fabric as well as in the case in which the nonwoven fabric is fixed on a carrier layer. It is even better if the percentage of pores is at least 92%, more preferably at least 94%, and especially more than 96%. The percentage of pores of the nonwoven fabric can be calculated from the bulk density of the nonwoven fabric and the density of the fibers in a manner known per se. The bulk density, in turn, can be calculated from the quotient of surface weight and thickness of the nonwoven fabric material.

$$\rho_{Rx} = \frac{m_A}{1000d} \qquad \text{Formula 1}$$

$\rho_{Rx}$ = bulk density $m_A$ = surface weight [g/m$^2$]

$d$ = layer thickness [mm]

-continued $$V_x = \frac{\rho_N - \rho_{Rx}}{\rho_N} 100 \qquad \text{Formula 2}$$

$V_x$ = Pore percentage [%]

$\rho_N$ = Density of nonwoven fibrous material [g/cm$^3$]

$\rho_{Rx}$ = bulk density [g/cm$^3$]

In principle, the polishing tool according to the invention may have any shape suitable for polishing a workpiece and in particular has the shape of the polishing tools already known from the state of the art. Preferably, the polishing tool is configured as a polishing disk, polishing belt, polishing sleeve or polishing pin. The polishing tool can be operated manually or by a machine, while both stationary, installed grinding or polishing units as well as handheld grinding or polishing machines can be used to drive it. The polishing tool according to the invention is suitable for machining various kinds of workpieces, e.g., those made of metal. It is particularly suitable for polishing steel surfaces, in particular stainless steel, aluminum, copper, brass or bronze. However, wooden or plastic surfaces can be machined as well.

BRIEF DESCRIPTION OF THE DRAWINGS

The invention will be explained in greater detail below with the help of drawings. The drawings describe preferred embodiments of polishing tools according to the invention without, however, limiting the invention to these embodiments. The drawings are purely schematic. Identical reference numerals indicate the same elements. Specifically, the Figures show:

FIG. 1(*b*) is a top view on the front side of the polishing sleeve according to FIG. 1(*a*);

FIG. 1(*c*) is a partial view of the carrier of the polishing sleeve according to FIGS. 1(*a*) and 1(*b*) prior to the application of polishing paste;

FIG. 1(*d*) is an enlarged view of a section of area A of FIG. 1(*b*);

DETAILED DESCRIPTION

Figure 1A:
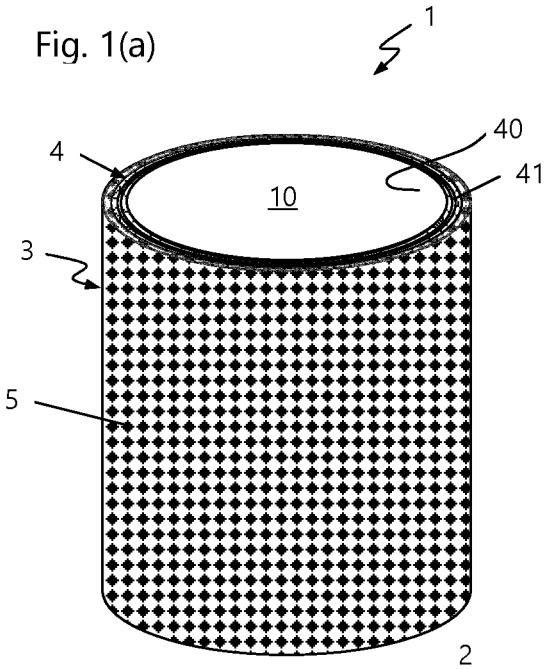
FIG. 1(*a*) is a perspective view of a polishing tool according to the invention in the form of a polishing sleeve.
Figure 1B:
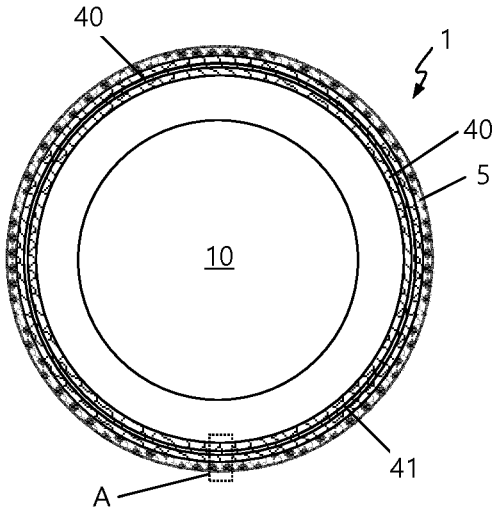
Figure 1C:
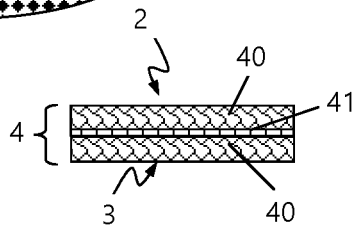
Figure 1D:
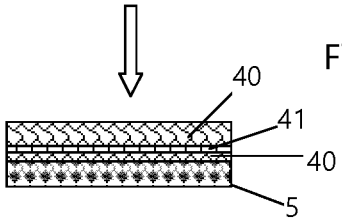

FIG. 1 shows a polishing tool 1 in the form of a polishing sleeve in which a cylindrical cavity 10 is enclosed by a hollow cylindrical body. During the polishing process, the polishing sleeve is rotated around its longitudinal axis, driven by, e.g., a handheld polishing machine. The jacket surface of the polishing sleeve thus represents the polishing surface 3 of the polishing tool 1. In the example shown, the polishing surface 3 is covered with polishing paste over its entire surface. This can occur, for example, by heating the polishing paste which is in a solid state at room temperature until it liquefies. It is applied to the polishing surface 3 of the carrier 2 of the polishing sleeve in the liquid state, for example, by spreading it with a spatula, by immersing the polishing surface in a bath with the liquefied polishing paste or similar processes. During this process, the liquefied polishing paste 5 penetrates the cavities between the fibers of the nonwoven fabric 4, which forms the polishing surface 3. This can be seen in FIG. 1(*d*), which shows an enlarged view of a section of region A of FIG. 1(*b*), which, in turn, is a top view of the front side of the polishing sleeve. The application of the polishing paste preferably occurs here in such a way that the paste is distributed as evenly as possible on the polishing surface 3 in an amount of 0.10 g/cm$^2$ to 0.25 g/cm$^2$. Typically, this does not result in a closed coating of the polishing surface with polishing paste, but rather the fiber structure of the nonwoven fabric 4 still remains visible under the coating of polishing paste.

FIG. 1(*c*) shows the carrier 2 and illustrates its multilayered structure. The carrier 2 consists of nonwoven fabric material 4, which in this case is fixed to both sides of a carrier layer 41 in two layers 40. The carrier layer consists, for example, of a woolen fabric on which the nonwoven fabric layers 40 are needle-punched. The carrier layer 41 conveys greater stability to the nonwoven fabric 4 with respect to its form. Of the nonwoven fabric layers 40, the lower one represents the polishing surface 3. Only this layer is coated with polishing paste 5, while the upper layer of FIG. 1(*c*) is not provided with polishing paste 5. For example, a material made of polyamide fibers with a pore percentage of more than 90%, preferably more than 94%, is used as the nonwoven fabric material. The latter is preferably a needle-punched nonwoven fabric or a velourized needle-punched fabric. The surface weight of the carrier 2 expediently lies in the range of 660 to 990 g/m$^2$.

Figure 2:
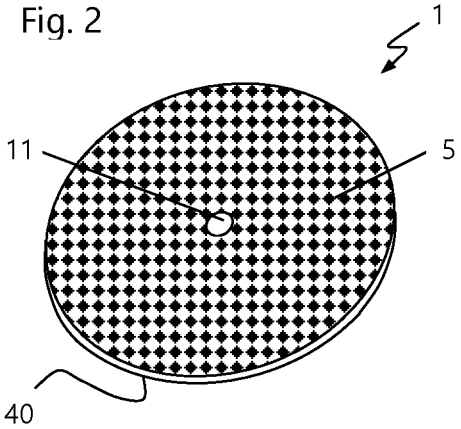
FIG. 2 is a perspective view of a further polishing tool in accordance with the invention in the form of a polishing disk.
Figure 3:
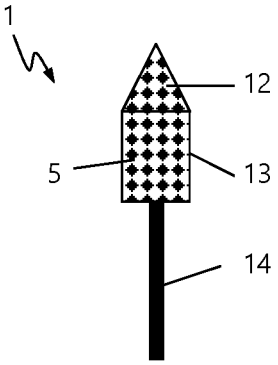
FIG. 3 is a side view of a polishing pin.
Figure 4:
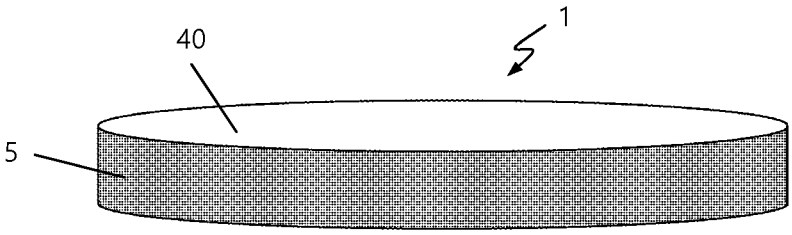
FIG. 4 is a perspective view of a further polishing tool in accordance with the invention in the form of a polishing belt.

The polishing tools according to the invention described in FIGS. 2 to 4 use the same or a similar carrier material for the carrier as described for FIGS. 1(*a*) through 1(*d*).

FIG. 2 shows a polishing disk comprising a carrier 2 corresponding to the one in FIG. 1(*c*). Again, as in FIG. 1(*d*), only one of the nonwoven fabric layers 40 is provided with polishing paste 5, in this case the surface of the polishing disk facing the observer. The polishing disk can be placed on a plastic support plate for polishing, the central opening 11 acting to center the disk on the support plate. The support plate is then fixed on the drive shaft of a grinding machine and rotated for the polishing process.

FIG. 3 shows a polishing pin with a polishing tip 12 and a polishing cylinder 13, which are held by a pin 14. The polishing tip 12 and polishing cylinder 13 may comprise, e.g., an inner body (not shown here) of wool felt or a similar carrier material, on which a layer of nonwoven fabric is fixed. In the example shown, the polishing paste 5 is applied to the outer surface of the polishing tip 12 as well as to the jacket surface of the polishing cylinder 13. However, it is also possible to provide only a part of the surfaces with polishing paste 5 and in particular to leave a part of the jacket surface adjacent to the carrier pin 14 of the polishing cylinder 13 free of polishing paste 5.

FIG. 4 shows a polishing tool 1 in the form of a polishing belt. Again, a carrier corresponding to the one shown in FIG. 1(*c*) is used. Polishing paste 5 has been applied to the outer surface of the belt, which constitutes the polishing surface, while the inner nonwoven fabric layer 40 is not provided with polishing paste.

The invention claimed is:

1. A polishing tool with integrated polishing paste comprising:

a carrier comprising a polishing surface, wherein the polishing surface is at least partially provided by a nonwoven fabric, wherein the polishing paste is solid at room temperature, wherein the polishing paste is disposed on at least a portion of the nonwoven fabric of the polishing surface in an amount of 0.08 g/cm$^2$ to 0.30 g/cm$^2$, and wherein the nonwoven fabric has a pore percentage $V_x$, wherein $$V_x = \frac{\rho_N - \rho_{Rx}}{\rho_N} 100$$

where $\rho_N$=density of fibrous material of nonwoven fabric (grams/cubic centimeter), and $\rho_{Rx}$=bulk density of nonwoven fabric (grams/cubic centimeter).

2. The polishing tool according to claim 1, wherein the carrier consist s of the nonwoven fabric.

3. The polishing tool according to claim 1, wherein the carrier comprises a carrier layer, and the nonwoven fabric is fixed on the carrier layer.

4. The polishing tool according to claim 1, wherein the nonwoven fabric is a synthetic nonwoven fabric.

5. The polishing tool according to claim 3, wherein the carrier layer is formed of wool.

6. The polishing tool according to claim 1, wherein the carrier has a surface weight in a range of 660 to 910 g/m$^2$ when the carrier has a material thickness of 4 mm.

7. The polishing tool according to claim 1, wherein the ore percentage $V_x$ of the nonwoven fabric is at least 90%.

8. The polishing tool according to claim 1, wherein the polishing paste contains polishing grains.

9. The polishing tool according to claim 1, wherein the polishing paste is disposed on the at least a portion of the polishing surface in an amount of 0.10 g/cm$^2$ to 0.25 g/cm$^2$.

10. The polishing tool according to claim 1, wherein the polishing surface has a polishing surface area, and the polishing paste is disposed on at least 80% of the polishing surface area of the polishing surface.

11. The polishing tool according to claim 1, wherein the polishing tool is a polishing disk, a polishing belt, a polishing sleeve or a polishing pin.

12. The polishing tool according to claim 4, wherein the synthetic nonwoven fabric is formed of at least one of polyamide and polyester.

13. The polishing tool according to claim 4, wherein the synthetic nonwoven fabric is a needle-punched nonwoven fabric.

14. The polishing tool according to claim 13, wherein the needle-punched nonwoven fabric is a velourized needle-punched nonwoven fabric.

15. The polishing tool according to claim 6, wherein the carrier has a surface weight in the range of 690 to 910 g/m$^2$ when the carrier has a material thickness of 4 mm.

16. The polishing tool according to claim 15, wherein the carrier has a surface weight in the range of 720 to 870 g/m$^2$ when the carrier has a material thickness of 4 mm.

17. The polishing tool according to claim 8, wherein the polishing grains comprise polishing grains formed of at least one of a soluble alkaline earth salt or polishing grains formed of ceramic.

18. The polishing tool according to claim 9, wherein the polishing paste is disposed on the at least a portion of the polishing surface in an amount of 0.11 g/cm$^2$ to 0.17 g/cm$^2$.

19. The polishing tool according to claim 10, wherein the polishing paste is disposed on at least 90% of the polishing surface area of the polishing surface.

* * * * *